United States Patent [19]

Sato et al.

[11] Patent Number: 4,781,016

[45] Date of Patent: Nov. 1, 1988

[54] STEEL CORDS

[75] Inventors: Michitaka Sato, Kokubunji; Toshio Sugawara, Higashiyamato, both of Japan

[73] Assignee: Bridgestone Corporation, Tokyo, Japan

[21] Appl. No.: 154,170

[22] Filed: Feb. 9, 1988

[30] Foreign Application Priority Data

Feb. 16, 1987 [JP] Japan ..... 62-19997[U]

[51] Int. Cl.[4] ..... D02G 3/48; B60C 9/00; D07B 1/06

[52] U.S. Cl. ..... 57/213; 57/212; 57/902; 152/451; 152/527; 152/556

[58] Field of Search ..... 57/210–216, 57/218, 219, 902; 152/451, 527, 556–563

[56] References Cited

U.S. PATENT DOCUMENTS

| | | | |
|---|---|---|---|
| 2,605,201 | 7/1952 | Howe | 57/902 X |
| 2,900,784 | 8/1959 | Fenner | 57/902 X |
| 3,972,175 | 8/1976 | Hiller | 57/213 |
| 4,158,946 | 6/1979 | Bourgois | 57/213 |
| 4,332,131 | 6/1982 | Palsky et al. | 57/215 X |
| 4,349,063 | 9/1982 | Kikuchi et al. | 57/212 X |
| 4,471,161 | 9/1984 | Drummond | 57/213 X |
| 4,586,324 | 5/1986 | Mizuma | 152/451 X |
| 4,608,817 | 9/1986 | Brandyberry et al. | 57/213 |
| 4,627,229 | 12/1986 | Bourgois | 152/556 X |
| 4,707,975 | 11/1987 | Umezawa | 57/902 X |

*Primary Examiner*—John Petrakes

*Attorney, Agent, or Firm*—Sughrue, Mion, Zinn, Macpeak & Seas

[57] ABSTRACT

A steel cord usable for the reinforcement of rubber articles comprises a core of a single steel filament, an inner sheath composed of six steel filaments and an outer sheath composed of 7 to 12 steel filaments, wherein the steel filaments constituting the core, inner sheath and outer sheath have a diameter of 0.20~0.40 mm and satisfy the particular relations.

5 Claims, 1 Drawing Sheet

STEEL CORDS

BACKGROUND OF THE INVENTION

1. Field of the Invention

This invention relates to steel cords as a reinforcement for rubber articles such as tire, rubber crawler, belt and so on.

2 Related Art Statement

As the steel cord reinforcing the conventional rubber article such as heavy duty pneumatic radial tire, FIG. 1 illustrates a known steel cord 7 of 3+9+15 layer construction comprising a core 2 composed of three twisted filaments 1, an inner sheath 4 composed of nine filaments 3 spirally wound around the core 2 and an outer sheath 6 composed of fifteen filaments 5 spirally wound around the inner sheath 4. Moreover, numeral 8 is a spiral filament. In case of using the steel cord 7, the resistance to tread cut and the resistance to belt end separation are good, but the resistance to cut separation is somewhat a problem. This is because, the filaments 1, 3 and 5 constituting the core 2, inner sheath 4 and outer sheath 6 close to each other to thereby form a space obstructing the penetration of rubber into the inside of the steel cord 7. When this space is formed inside the steel cord 7, if cut failure is produced, for example, in the tread and water arrives at the steel cord through the cut failure, the water intrudes into the space to cause rust. Thus, a separation failure is caused at the boundary between the steel cord 7 and rubber.

In order to solve this problem, there has hitherto been proposed a steel cord as disclosed in U.S. Pat. No. 4,158,946 (corresponding to Japanese Patent laid open No. 54-50,640). In this steel cord, the number of filaments constituting the inner and outer sheaths is reduced to form minute gaps between filaments constituting the inner sheath and the outer sheath for penetrating rubber into the inner and outer sheaths.

Furthermore, Japanese Utility Model laid open No. 56-103,092 discloses a steel cord of 3+9+15 layer construction, wherein the diameter of the core is increased by 5~60% with respect to the filament diameter of each of the second and third layers.

Even in the latter steel cords, however, the resistance to cut separation could not sufficiently be enhanced because a triangular space obstructing the intrusion of rubber remains in the center of the core composed of three closed filaments. As a result, if water penetrates into this space, rust is produced to cause the separation failure as mentioned above.

SUMMARY OF THE INVENTION

It is, therefore, an object of the invention to provide a steel cord which solves the aforementioned problems of the conventional steel cords.

According to the invention, there is the provision of a steel cord comprising a core of a single steel filament, an inner sheath composed of six steel filaments spirally wound around the core, and an outer sheath composed of n steel filaments spirally wound around the inner sheath; filament number n of the outer sheath being within a range of 7~12, and a diameter of the steel filament constituting each of the core, inner sheath and outer sheath being within a range of 0.20 mm to 0.40 mm and satisfying the following relations:

(a) $n=7\sim11$ $d_c \geqq 0.04+d_1$ and $d_1 \geqq d_2$ (b) $n=12$ $d_c \geqq 0.04+d_1$ and $d_2 \geqq 0.350\ (d_c+2d_1)-0.027$, wherein $d_c$ is a diameter of the core (mm), $d_1$ is a diameter of the inner sheath (mm) and $d_2$ is a diameter of the outer sheath (mm).

According to the invention, the core is composed of a single steel filament, so that the space is never formed in the inside of the core. Furthermore, the number of steel filaments constituting the inner or outer sheath is within the above defined range, so that minute gaps capable of passing rubber are formed between these filaments. Thus, if water arrives at the steel cords, there is no occurrence of separation failure because no space for intrusion of water is existent around the filaments constituting the steel cord.

BRIEF DESCRIPTION OF THE DRAWINGS

The invention will be described with reference to the accompanying drawings, wherein.

DESCRIPTION OF THE PREFERRED EMBODIMENTS

Figure 1:
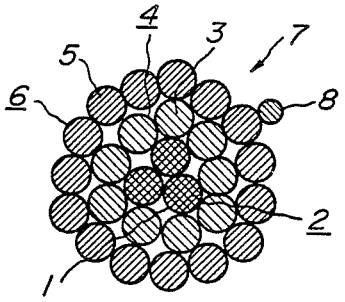
FIG 1 PRIOR ART
FIG. 1 is a schematically sectional view of the conventional steel cord.
Figure 2:
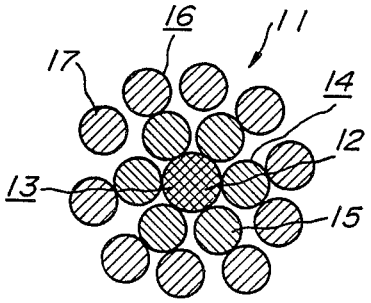
FIG. 2 is a schematically sectional view of an embodiment of the steel cord according to the invention.

In FIG. 2 is shown an embodiment of the steel cord according to the invention used as a reinforcement for rubber articles such as pneumatic tire, rubber crawler, belt, pressure hose and the like. The steel cord 11 has a core 13 composed of a single steel filament 12 in its center. Around the core 13 is spirally wound an inner sheath 14 composed of six steel filaments 15. The twisting pitch of the filament 15 or twisting pitch $S_1$ of the inner sheath 14 is preferable to be within a range of 6 mm to 18 mm. When the twisting pitch $S_1$ of the inner sheath 14 is less than 6 mm, the cord strength of the steel cord 11 is too low, while when it exceeds 18 mm, the fatigue resistance lowers to reduce the tire durability. Further, an outer sheath 16 composed of n steel filaments 17 is spirally wound around the inner sheath 14. The number n of the filaments 7 should be within a range of 7 to 12. When n is not more than 6, the shape of the steel cord 11 becomes unstable, while when n is not less than 13, the space between mutual filaments 17 becomes too narrow and rubber can not penetrate into the inside of the outer sheath 16. The twisting pitch of the filament 17 or twisting pitch $S_2$ of the outer sheath 16 is longer than the twisting pitch $S_1$ of the inner sheath 14 and is preferable to be within a sum of the twisting pitch $S_1$ and 10 mm. When the twisting pitch $S_2$ of the outer sheath 16 is equal to or less than the twisting pitch $S_1$ of the inner sheath 14, if tension is applied to the steel cord 11, the load bearing of the inner sheath 14 becomes too large and the cord durability lowers, while when the twisting pitch $S_2$ is longer than the sum of the twisting pitch $S_1$ and 10 mm, the fatigue resistance lowers to reduce the tire durability. Moreover, the twisting directions of the filaments 15 and 17 in the inner sheath 14 and the outer sheath 16 may be the same or different, but it is rather preferable to twist the filaments 15 and 17 in opposite directions because the intrusion of rubber into the steel cord 11 becomes easy.

In addition, the diameter of each of the filaments 12, 15 and 17 should be within a range of 0.20 mm to 0.40 mm. When the diameter is less than 0.20 mm, the strength of the steel cord 11 is low and if the steel cord is used as a reinforcement for the belt layer of the tire, the rigidity of the belt becomes lacking. While, when the diameter exceeds 0.40 mm, the diameter of the steel cord 11 becomes larger and the pitch between the cords is narrow to decrease the amount of rubber interposed between the cords. Consequently, the stress propagation of cut input can not be suppressed and the cut failure is apt to be caused in the tread. The diameter of each of the filaments 12, 15 and 17 constituting each of the core 13, inner sheath 14 and outer sheath 16 is preferably within a range of 0.24 mm to 0.36 mm.

The relation among diameters $d_c$, $d_1$ and $d_2$ of the filaments 12, 15 and 17 for the core 13, inner sheath 14 and outer sheath 16 is required to satisfy $d_c \geqq 0.04 + d_l$ irrespective of n value. When the difference in the filament diameter between the core and the inner or outer sheath is less than 0.04 mm, the gap capable of passing rubber can not be formed between the filaments 15 in the inner sheath 14.

In case of $n = 7 \sim 11$, it is necessary to satisfy a relation of $d_1 \geqq d_2$. If $d_1 \geqq d_2$, the space between the filaments 17 in the outer sheath 16 becomes narrower and the diameter of the steel cord is large, so that when the steel cords are arranged and embedded in rubber, for example, as a reinforcement for the belt of the tire, the distance between the embedded cords becomes narrow and the amount of rubber interposed between the cords is less. Consequently, the stress propagation of sudden input when riding on protrusions from road surface can not be suppressed and hence the cut failure is apt to be caused in the tire tread.

In case of $n = 12$, it is necessary to satisfy a relation of $d_2 \geqq 0.350(d_c + 2d_1) - 0.027$. When $d_2 \geqq 0.350(d_c + 2d_1) - 0.027$, rubber can not penetrate between the filaments 17 in the outer sheath 16.

Thus, the steel cord 11 has a three layer construction of $1 + 6 + n$.

In the vulcanization of a rubber article containing the above steel cords 11, since minute gaps are formed between the filaments 17 of the outer sheath 16 and between the filaments 15 of the inner sheath 14, rubber easily penetrates between the filaments 17, 15 into the outer sheath 16 and inner sheath 14 and consequently spaces around the filaments 12, 15, 17 in the core 13, inner sheath 14 and outer sheath 16 are substantially filled with rubber. When such a rubber article is used over a long period of time, a cut failure arriving at the embedded steel cord 11 may be caused in the rubber article, but even if water intrudes into the steel cord through this cut, since the space is not existent in the inside of the steel cord 11 and all filaments 12, 15, 17 are bonded to rubber, there is hardly produced rust due to the presence of water and the resistance to cut separation is considerably improved.

When using filaments having different diameters as in the invention (particularly, the diameter becomes small in the order of the core, the inner sheath and the outer sheath), if tension is applied to the cord, the tension bearing of the filaments in the core, inner sheath and outer sheath tend to become uniform as compared with the use of filaments having the same diameter, which is more preferable in view of the cord durability.

In the formation of the steel cord according to the invention, a steel filament having a carbon content of 0.70~0.90 wt % is usually used. Particularly, the use of steel filament having a carbon content of 0.80~0.85 wt % is preferable because it provides a high strength and a good toughness.

The steel cord according to the invention is preferably applied to a carcass ply for tires, particularly heavy duty pneumatic radial tire.

The invention will be described in detail with reference to the following example.

EXAMPLE

Two conventional tires were reinforced with conventional steel cords, eight test tires reinforced with steel cords according to the invention, and three comparative tires reinforced with steel cords outside the scope of the invention, respectively. In the conventional tires 1 and 2, the twisting pitch of the steel cord was 6 mm in the core, 12 mm in the inner sheath and 18 mm in the outer sheath. In the test tires 2, 3, 4 and 6, the twisting pitch of the steel cord was straight in the core, 10.7 mm in the inner sheath and 18.7 mm in the outer sheath. In the tires other than the above mentioned tires, the twisting pitch was straight in the core, 10 mm in the inner sheath and 17.5 mm in the outer sheath. Moreover, the twisting directions of the inner sheath and the outer sheath in the test tires 1~6 were different, while the twisting directions of the inner sheath and the outer sheath in the test tires 7 and 8 were the same. The diameter of each of the filaments constituting the core, inner sheath and outer sheath of the steel cord was shown in the following Table 1. And also, the carbon content of the steel filament in all of the steel cords was 0.82 wt %.

Each of these tires was a large size radial tire for truck and bus reinforced with four belt layers (first, second, third and fourth belt plies viewed from the inside of the tire) and had a size of 1000R20 14PR. In these tires, the steel cords of the second and third belt plies as shown in Table 1 were crossed with each other at an angle of 20° with respect to the equatorial plane of the tire, but in this case, the cord strength and end count were adjusted so as to make the total strength of these belt plies as shown in Table 1.

Each of these tires subjected to an internal pressure of 7.25 kgf/cm$^2$ was actually run on a general road including 20% of bad road under a 100% loading over a distance of 30,000 km and thereafter the resistance to cut separation was measured with respect to these tires to obtain results as shown in Table 1. As seen from the results of Table 1, the resistance to cut failure is considerably improved in the test tires as compared with the conventional tires and comparative tires. The resistance to cut separation was evaluated by peeling off the fourth belt ply from the third belt ply in the tire, searching a position of producing tread cut on the third belt ply and measuring a maximum length of poor adhesion of steel cord at this position by means of calipers.

Furthermore, the resistance to tread cut and resistance to belt end separation were measured with respect to the tires after the actual running to obtain results as shown in Table 1. It is apparent from the results of Table 1 that the resistance to tread cut and the resistance to belt end separation of the test tires are substantially equal to those of the conventional tires. In this case, the resistance to tread cut was evaluated by peeling off the tread from the fourth belt ply in the tire and measuring the number of cuts arrived at the fourth belt ply and represented by an index on the basis that the conventional tire 1 was 100. The larger the numerical value, the better the resistance to tread cut. On the other hand, the resistance to belt end separation was evaluated by peeling off the third belt ply from the second belt ply in the tire to expose cord the end of the third belt ply and measuring a maximum length of poor adhesion produced at the cord end of the third belt ply by means of calipers.

TABLE 1(a)

| Kind of tire | Conventional tire 1 | Test tire 1 | Test tire 2 | Test tire 3 | Test tire 4 | Comparative tire 1 | Comparative tire 2 |
|---|---|---|---|---|---|---|---|
| Twisting construction | 3 + 9 + 15 | 1 + 6 + 12 | 1 + 6 + 11 | 1 + 6 + 10 | 1 + 6 + 12 | 1 + 6 + 13 | 1 + 6 + 12 |
| Twisting direction | | | | | | | |
| core | S | — | — | — | — | — | — |
| inner sheath | S | S | S | S | S | S | S |
| outer sheath | Z | Z | Z | Z | Z | Z | Z |
| Filament diameter (mm) | | | | | | | |
| core | 0.23 | 0.30 | 0.32 | 0.32 | 0.32 | 0.30 | 0.30 |
| inner sheath | 0.23 | 0.26 | 0.28 | 0.28 | 0.28 | 0.26 | 0.26 |
| outer sheath | 0.23 | 0.26 | 0.28 | 0.28 | 0.26 | 0.26 | 0.28 |
| Cord strength (kg) | 306 | 297 | 318 | 301 | 312 | 313 | 321 |
| End count (cords/50 mm) | 18.3 | 18.9 | 17.6 | 18.6 | 17.9 | 17.9 | 17.4 |
| Total strength (kg/50 mm) | 5,600 | 5,600 | 5,600 | 5,600 | 5,600 | 5,600 | 5,600 |
| Tire performances | | | | | | | |
| resistance to belt end separation (mm) | 5~7 | 5~7 | 5~7 | 5~7 | 3~5 | 5~7 | 3~5 |
| resistance to tread cut (index) | 100 | 101 | 100 | 100 | 100 | 100 | 100 |
| resistance to cut separation (mm) | 20~30 | 0~3 | 0~3 | 0~3 | 0~3 | 20~30 | 20~30 |

TABLE 1(b)

| Kind of tire | Conventional tire 2 | Test tire 5 | Test tire 6 | Comparative tire 3 | Test tire 7 | Test tire 8 |
|---|---|---|---|---|---|---|
| Twisting construction | 3 + 9 + 15 | 1 + 6 + 12 | 1 + 6 + 11 | 1 + 6 + 13 | 1 + 6 + 12 | 1 + 6 + 11 |
| Twisting direction | | | | | | |
| core | S | — | — | — | — | — |
| inner sheath | S | S | S | S | S | S |
| outer sheath | Z | Z | Z | Z | S | S |
| Filament diameter (mm) | | | | | | |
| core | 0.23 | 0.30 | 0.32 | 0.30 | 0.30 | 0.32 |
| inner sheath | 0.23 | 0.26 | 0.28 | 0.26 | 0.26 | 0.28 |
| outer sheath | 0.23 | 0.26 | 0.28 | 0.26 | 0.26 | 0.28 |
| Cord strength (kg) | 306 | 297 | 318 | 313 | 307 | 329 |
| End count (cords/50 mm) | 22.9 | 23.6 | 22.0 | 22.4 | 22.8 | 21.3 |
| Total stength (kg/50 mm) | 7,000 | 7,000 | 7,000 | 7,000 | 7,000 | 7,000 |
| Tire performances | | | | | | |
| resistance to belt end separation (mm) | 3~5 | 3~5 | 3~5 | 3~5 | 3~5 | 3~5 |
| resistance to tread cut (index) | 100 | 101 | 100 | 100 | 101 | 100 |
| resistance to cut separation (mm) | 20~30 | 0~3 | 0~3 | 20~30 | 6~8 | 6~8 |

As mentioned above, according to the invention, the resistance to cut separation in the rubber articles can considerably be improved without degrading the other performance such as resistance to tread cut and resistance to belt end separation.

What is claimed is:

1. A steel cord comprising a core of a single steel filament, an inner sheath composed of six steel filaments spirally wound around the core, and an outer sheath composed of n steel filaments spirally wound around the inner sheath; filament number n of the outer sheath being within a range of 7~12, and a diameter of the steel filament constituting each of the core, inner sheath and outer sheath being within a range of 0.20 mm to 0.40 mm and satisfying the following relations:

(a)

$n=7\sim11$ $d_c \geqq 0.04+d_1$ and $d_1 \geqq d_2$ (b)

$n=12$ $d_c 0.04+d_1$, and $d_2 \geqq 0.350\ (d_c+2d_1)-0.027$ wherein $d_c$ is a diameter to the core (mm), $d_1$ is a diameter of the inner sheath (mm) and $d_2$ is a diameter of the outer sheath (mm).

2. The steel cord according to claim 1, wherein said inner sheath has a twisting pitch of 6 to 18 mm and said outer sheath has a twisting pitch longer than that of said inner sheath and is within a sum of the twisting pitch of said inner sheath and 10 mm.

3. The steel cord according to claim 1, wherein twisting directions of said inner and outer sheaths are the same.

4. The steel cord according to claim 1, wherein said diameter is within a range of 0.24 to 0.36 mm.

5. The steel cord according to claim 1, wherein said steel filament has a carbon content of 0.70~0.90 wt %.

6. The steel cord according to claim 1, wherein twisting directions of said inner and outer sheaths are different.

* * * * *

UNITED STATES PATENT AND TRADEMARK OFFICE

CERTIFICATE OF CORRECTION

PATENT NO. : 4,781,016

DATED : November 1, 1988

INVENTOR(S) : Michitaka SATO and Toshio SUGAWARA

It is certified that error appears in the above-identified patent and that said Letters Patent is hereby corrected as shown below:

Column 2, lines 1 and 5, formulas (a) and (b) should be to the left hand side of margin, not centered.

Column 2, line 6, "$d_2 \geqq 0.350(d_c-2d_1)-0.027$" should read --$d_2 \leqq 0.350(d_e+2d_1)-0.027$--.

Column 3, line 25, "If $d_1 \geqq d_2$" should read --If $d_1 < d_2$--.

Column 3, lines 37 and 38, "$d_2 \geqq 0.350(d_c+2d_1)-0.027$" should read --$d_2 \leqq 0.350(d_c+2d_1)-0.027$-- and "$d_2 \geqq 0.350(d_c+2d_1)-0.027$" should read --$d_2 > -.0.350$ (dc & 2d,)-0.027--

Column 6, line 50, "$d_c 0.04+d_1$, and $d_2 \geqq 0.350(d_c+2d_1)-0.027$" should read --$d_c \geqq 0.04+d_1$, and $d_2 \leqq 0.350(d_c+2d_1)-0.027$--.

Signed and Sealed this

Twenty-third Day of October, 1990

*Attest:*

HARRY F. MANBECK, JR.

*Attesting Officer*

*Commissioner of Patents and Trademarks*